US007703373B2

(12) United States Patent
Gaigler et al.

(10) Patent No.: US 7,703,373 B2
(45) Date of Patent: Apr. 27, 2010

(54) UNITARY ELECTRO MAGNETIC COIL LAUNCH TUBE

(75) Inventors: Randy L. Gaigler, Parkville, MD (US); Mark R. Alberding, Glen Arm, MD (US); Leszek Stanislaw Basak, Nottingham, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 422 days.

(21) Appl. No.: 11/428,697

(22) Filed: Jul. 5, 2006

(65) Prior Publication Data

US 2008/0006144 A1 Jan. 10, 2008

(51) Int. Cl.
*F41F 1/00* (2006.01)
*F41B 6/00* (2006.01)
*H02K 41/02* (2006.01)

(52) U.S. Cl. ..... 89/8; 124/3; 310/14

(58) Field of Classification Search ..... 89/8, 89/1.8; 310/12, 13, 12.01; 206/3; 124/3
See application file for complete search history.

(56) References Cited

U.S. PATENT DOCUMENTS

| | | | | | |
|---|---|---|---|---|---|
| 2,783,684 | A | * | 3/1957 | Yolcr | 89/7 |
| 3,135,879 | A | * | 6/1964 | Baumann | 310/13 |
| 4,460,855 | A | * | 7/1984 | Kelly | 318/135 |
| 4,480,523 | A | * | 11/1984 | Young et al. | 89/8 |
| 4,791,850 | A | | 12/1988 | Minovitch | |
| 4,996,903 | A | * | 3/1991 | Arakaki | 89/8 |
| 5,079,459 | A | * | 1/1992 | Huston et al. | 310/15 |
| 5,093,313 | A | * | 3/1992 | Minovitch | 505/164 |
| 5,294,850 | A | * | 3/1994 | Weh et al. | 310/13 |
| 6,361,393 | B1 | | 3/2002 | Seymour | |
| 2004/0056536 | A1 | * | 3/2004 | Finkbeiner et al. | 310/12 |
| 2004/0100152 | A1 | * | 5/2004 | Finkbeiner et al. | 310/12 |
| 2005/0121985 | A1 | * | 6/2005 | Hartramph et al. | 310/14 |

* cited by examiner

*Primary Examiner*—Bret Hayes
(74) *Attorney, Agent, or Firm*—DeMont & Breyer, LLC

(57) ABSTRACT

An electromagnetic missile launcher is disclosed that provides greater flexibility for use with a variety of missile types and also provides potentially higher performance and efficiency as compared to prior-art electromagnetic missile launchers.

18 Claims, 7 Drawing Sheets

UNITARY ELECTRO MAGNETIC COIL LAUNCH TUBE

FIELD OF THE INVENTION

The present invention relates to missilery in general, and, more particularly, to missile launchers.

BACKGROUND OF THE INVENTION

During launch of a missile that contains a chemical booster, a thrust-providing plume of exhaust gas is generated. The exhaust gas is extremely hot (in excess of 5000° F.) and very erosive due to the presence of metallic particulates. Booster-assisted launch, which is typically referred to as "hot launch," has a number of drawbacks, including:

- heating of the launch platform, which creates a readily-identifiable thermal signature;
- obscuring the visibility and/or temporarily blinding missile-launch personnel;
- impairing radar systems in the vicinity of the launch platform due to the presence of the metallic particulates in the missile exhaust; and
- the difficulty of adequately venting the exhaust gas from relatively larger missiles, which, in comparison with smaller missiles, is relatively hotter and more voluminous.

To address these problems, "cold launch" technologies are being developed. One promising cold-launch technology is the electromagnetic missile launcher. In current electromagnetic missile launchers, plural, independently-addressable, preformed coils are stacked around a cylindrical launch tube. During a typical electromagnetic launch, electric current is sequenced through these coils to accelerate an armature that is located within the launch tube. The moving armature propels a missile to launch velocity.

Although prior-art electromagnetic launchers effectively address the problems of hot launch, they suffer from other drawbacks. In particular, prior-art electromagnetic launchers have relatively low propulsion efficiency. Furthermore, some prior-art electromagnetic missile launchers are relatively inflexible in that they have essentially no ability to accommodate missiles that vary from a design diameter. In addition, the weight, size, reliability, and complexity of prior-art electromagnetic launchers are negatively impacted by the manner in which they are fabricated.

SUMMARY OF THE INVENTION

The present invention enables the electromagnetic launch of a missile without some of the costs and disadvantages for doing so in the prior art.

Embodiments of the present invention, like the prior art, use a plurality of propulsion coils arrayed along the length of a tube to eject a missile from the tube with sufficient velocity for flight. In some prior art electromagnetic launchers, the propulsion coils are equally-sized, stackable coils that each act as an independent unit during launch. As a result, these prior-art electromagnetic launchers are limited in their ability to: 1) vary the dimensional properties of their propulsion coils, and 2) reduce the minimum separation between the propulsion coils and an armature that propels the missile within the tube. In addition, the minimum separation between the propulsion coils and the armature in prior-art electromagnetic launchers includes extra space, which is required to facilitate their assembly. The increased separation distance reduces the efficiency of prior-art electromagnetic launchers.

In contrast to the prior art, the present invention comprises propulsion coils that are formed directly onto the outer surface of the tube. As a result, embodiments of missile launchers in accordance with the present invention can have readily varied coil sizes, coil diameters, coil spacings, and coil wire sizes, as a function of the tube size. In addition, embodiments in accordance with the present invention can have a smaller minimum spacing between the propulsion coils and the armature.

Embodiments of the present invention derive any one or more of the following advantages over the prior art:

1) improved performance;
2) greater efficiency;
3) less complexity;
4) reduced launcher size and/or weight;
5) increased flexibility for use with different missile types; and
6) improved reliability.

Like prior-art electromagnetic missile launchers, embodiments of the present invention eject a missile from a tube by accelerating an armature. The armature is accelerated by a force that arises due to mutual inductance between the armature and a plurality of propulsion coils that carry electric current. The flow of electric current in each propulsion coil is controlled and sequenced by a power system that is electrically-connected to the propulsion coils. But the efficiency with which the propulsion coils of launchers disclosed herein propel the armature is improved over prior-art electromagnetic missile launchers. A reason for this is that the minimum separation between the propulsion coils and the armature of the present launcher is less than for prior-art launchers.

An embodiment of the present invention comprises:

- a tube for encircling an armature, wherein the tube has an outer surface;
- a first coil for conducting electric current, wherein the first coil is substantially immovable with respect to the tube, and wherein a portion of the first coil is physically-coupled to the outer surface of the tube;
- a second coil for conducting electric current, wherein the second coil is substantially immovable with respect to the tube, and wherein a portion of the second coil is physically-coupled to the outer surface of the tube; and
- the armature, wherein the armature comprises a third coil for conducting electric current, and wherein the third coil is substantially immovable with respect to the armature;
- wherein the flow of electric current in at least one of the first coil and the second coil induces the armature to move with respect to the tube.

DETAILED DESCRIPTION

Figure 1:
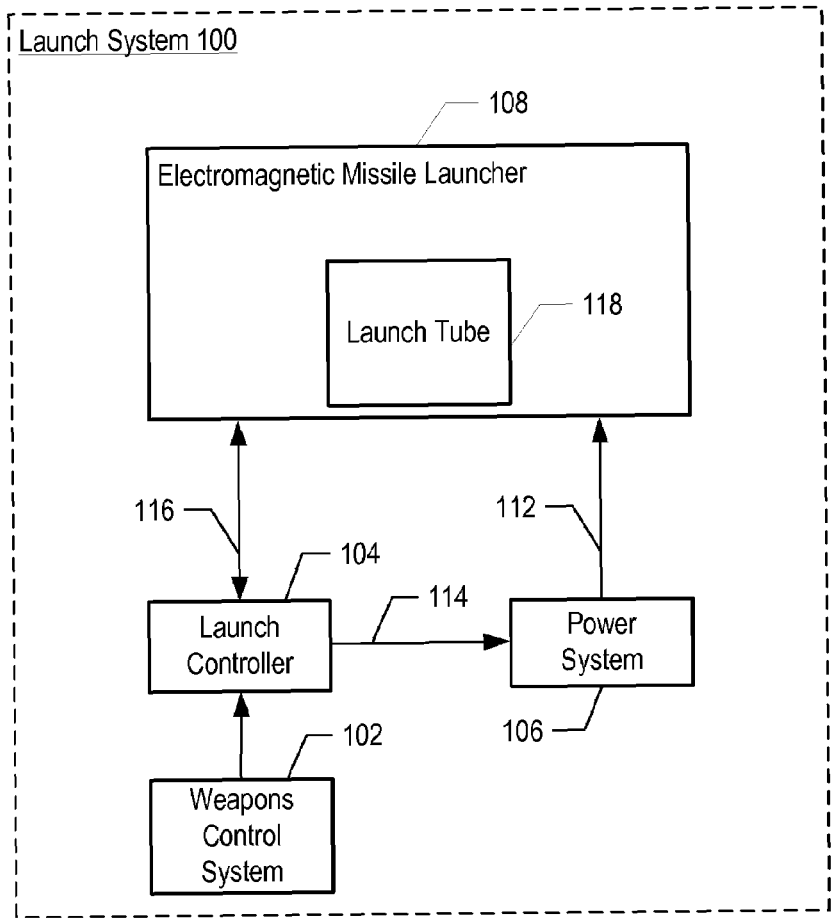
FIG. 1 depicts a schematic of the salient components of a launch system according to an illustrative embodiment of the present invention.

FIG. 1 depicts a schematic of the salient components of a launch system according to an illustrative embodiment of the present invention. Launch system 100 comprises electromagnetic missile launcher 108, weapons control system 102, launch controller 104, power system 106, propulsion current bus 112, signal line 114, and data bus 116. Launch system 100 is described in U.S. patent application Ser. No. 10/899,234, filed Sep. 26, 2004, which is incorporated by reference herein.

Electromagnetic missile launcher 108 (hereinafter "launcher 108") is a system that has the capability to house and expel a conventional missile upon command. A conventional missile typically comprises an explosive warhead and a chemical-propellant engine. Launcher 108 comprises launch tube 118. Launcher 108 expels a missile from launch tube 118 using an electromagnetic catapult and without the aid of the missile's chemical-propulsion engine. This is advantageous because it enables the missile to clear the launch platform before engine start, which mitigates the aforementioned problems of hot launch.

Weapons control system 102 provides targeting and flight information and firing authority to launch controller 104 prior to and during a launch sequence.

Launch controller 104 provides the targeting and flight information to a missile prior to launch and also provides the directive to launch to power system 106.

Power system 106 comprises circuitry that conditions and manages the storage and delivery of power to launcher 108 in response to signals from launch controller 104. Power system 106 controls power generation, storage, and delivery prior to, during, and after each launch.

Propulsion current bus 112 carries power from power system 106 to launcher 108.

Signal line 114 connects launch controller 104 to power system 106 and carries the commands that direct power system 106 to initiate and control the launch of a missile. Data bus 116 carries the targeting information from launch controller 104 to launcher 108.

Figure 2:
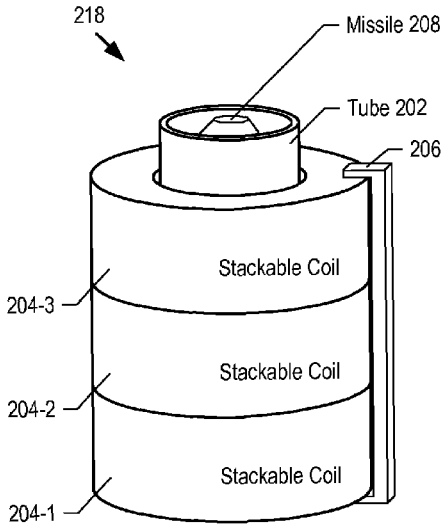
Figure 2 (Prior Art)
FIG. 2 depicts a perspective drawing of a prior-art launch tube.

FIG. 2 depicts a perspective drawing of a prior-art launch tube. Stackable coil launch tube 218 comprises tube 202, three stackable coils 204-1 through 204-3, and clamps 206. For clarity, the interconnection of stackable coil launch tube 218 and propulsion current bus 112 is not shown.

Tube 202 is a cylindrical tube that has sufficient interior diameter to accommodate missile 208 and sufficient strength to withstand the forces exerted on tube 202 during a missile launch.

Stackable coils 204-1 through 204-3 (referred to collectively as stackable coils 204) are described in detail below and with reference to FIG. 4. Stackable coils 204 are the propulsion coils for stackable coil launch tube 218.

Clamp 206 is a metal clamp which holds stackable coils 204 together prior to, during, and after a missile launch.

Missile 208 is a conventional missile which comprises an explosive warhead and a chemical-propellant engine. Missile 208 resides within tube 202 and is attached to armature 304 (described below and with respect to FIG. 3) via missile restraint bolts.

Stackable coil launch tube 218 is assembled by sliding each of equal size stackable coils 204-1, 204-2, and 204-3 over tube 202, thereby stacking them. Stackable coils 204 surround the outer diameter of tube 202. Each of the stackable coils has an interior diameter large enough to accommodate tube 202, plus additional clearance to facilitate assembly. Once stackable coils 204 are stacked around tube 202, they are clamped together by clamps 206. Clamps 206 impede motion of stackable coils 204 in response to forces to which each is subjected during a missile launch.

Stackable coil launch tube 218 is assembled using a stackable coil assembly approach. The use of this approach, however, can lead to any of several undesirable consequences. For example, space must be added to some components to accommodate assembly. As explained below, these gaps increase the separation between the propulsion coils and the armature, which in turn leads to a reduction of the propulsion efficiency. In addition, the use of uniformly-sized stackable coils limits the flexibility of the launcher. This, in turn, limits the limits the utility of the stackable coil approach for missiles of various types and sizes. Further, misalignment between coils stacked around the tube degrades the efficiency of the launcher. Finally, since each stackable coil is an independent unit, the propulsive force generated during a launch can act to drive the stackable coils apart. Banding and/or clamps, such as clamp 206, are therefore required to keep the stackable coils from separating during launch. The addition of banding and/or clamps undesirably increases the weight, size, and/or complexity of prior-art electromagnetic missile launchers.

Figure 3:
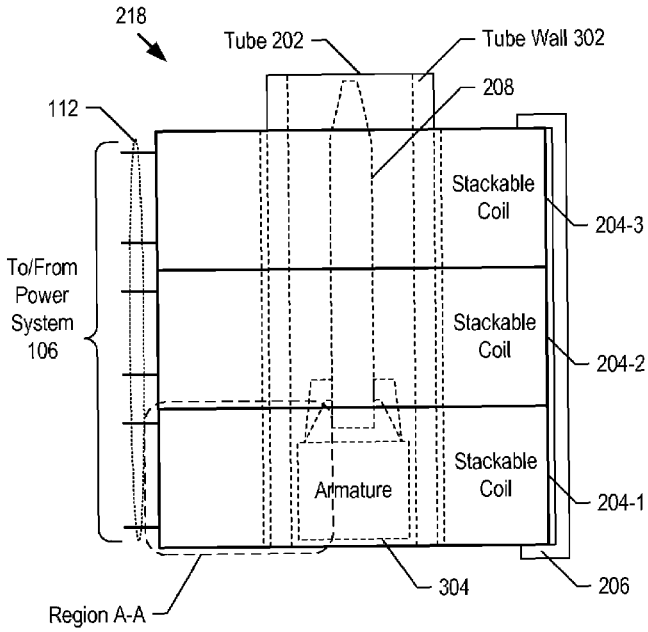
Figure 3 (Prior Art)
FIG. 3 depicts a side view of prior-art stackable coil launch tube 218.

FIG. 3 depicts a side view of prior-art stackable coil launch tube 218. Armature 304, which is included in stackable coil launch tube 218 but can not be seen in FIG. 2, comprises a rigid platform and an armature coil. Armature 304 is described in more detail below and with reference to FIG. 4.

During the launch of missile 208, power system 106 energizes stackable coil 204-1 with electric current via propulsion current bus 112. The flow of electric current in stackable coil 204-1 causes a mutual inductance between stackable coil 204-1 and the armature coil in armature 304. The mutual inductance between the propulsion coils and the armature coil results in a force that accelerates armature 304 toward the muzzle end of stackable coil launch tube 218. As armature 304 moves, power system 106 sequences the flow of electric current from stackable coil 204-1 to stackable coil 204-2 and then to stackable coil 204-3. The sequencing of the flow of electric current serves to maintain the acceleration of armature 304 and missile 208 so as to impart sufficient velocity to the missile for it to achieve aerodynamic flight. Once missile 208 has attained sufficient velocity, armature 304 decelerates and the missile restraint bolts (not shown) that hold it to armature 304 are broken. Missile 208 is thereby thrown free of launcher 108. Once sufficient separation between missile 208 and launcher 108 is achieved, the chemical-propellant engine of missile 208 ignites and the missile continues its flight toward its target.

The efficiency with which stackable coil launch tube 218 accelerates missile 208 is inversely proportional to the separation between the electrical conductors in stackable coils 204 and armature 304 (specifically, the armature coil included in armature 304). It is desirable, therefore, to keep this separation as small as possible, as a more efficient launcher can be smaller, lighter, and less expensive. Unfortunately, the use of a stackable coil approach for fabrication of stackable coil launch tube 218 results in a larger separation between the propulsion and armature coils. This is described in more detail below and with respect to FIG. 4.

Figure 4:
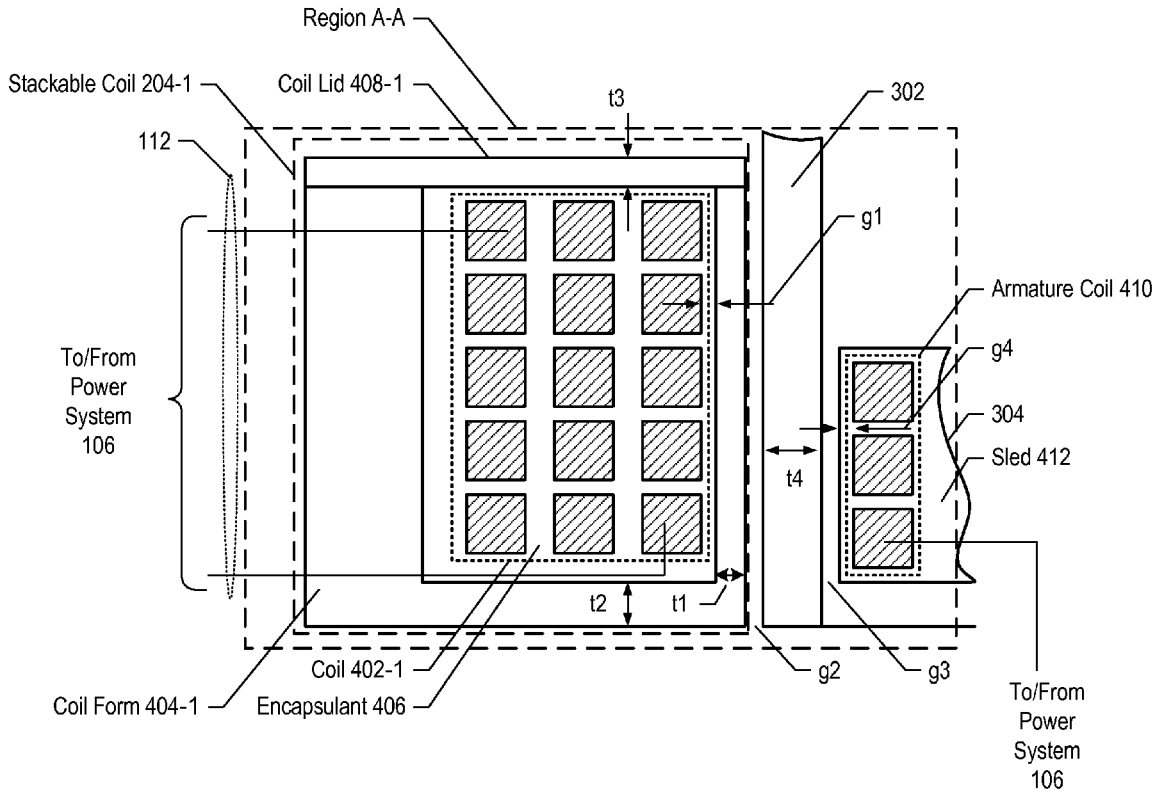
Figure 4 (Prior Art)
FIG. 4 depicts a cross-sectional view of the coil arrangement of prior-art stackable coil launch tube 218 in a pre-launch state.

FIG. 4 shows a cross-section of region A-A of FIG. 3, which depicts prior-art stackable coil 204-1 and armature 304 in a pre-launch state. Stackable coil 204-1 comprises coil 402-1, coil form 404-1, and coil lid 408-1. Stackable coil 204-1 is representative of each of stackable coils 204, which are substantially identical. Armature 304 comprises armature coil 410 and sled 412.

Sled 412 is a rigid platform suitable for holding missile 208 and locating armature coil 410.

Armature coil 410 is a length of electrical conductor that is suitable for developing a mutual inductance with energized coils 402. Armature coil 410 is substantially immovable with respect to sled 412.

Coil 402-1 is a length of electrical conductor that is suitable for carrying sufficient electric current to accelerate armature 304. Coil 402-1 is representative of each of coils 402. The propulsive force provided by coil 402-1 to armature 304 is a function of the number of turns in coil 402-1, the current carried by coil 402-1, and the separation between coil 402-1 and the armature coil in armature 304.

Coil form 404-1 is a hollow annulus of fiber-reinforced epoxy with an opening appropriate for locating coil 402-1. Coil form 404-1 is representative of each of coil forms 404. The opening in coil form 404-1 is defined by an inner hub, which has a hub wall thickness of t1, a bottom, which has a bottom thickness of t2, and an outer hub. The opening in coil form 404-1 is slightly larger than the relevant dimensions of coil 402-1 so that coil 402-1 can be inserted into it.

Coil lid 408-1 is a lid of fiber-reinforced epoxy for enclosing coil 402-1 in the opening of coil form 404-1. Coil lid has a coil lid thickness of t3.

Stackable coil 204-1 is formed by first winding coil 402-1 on a winding tool. Once wound, coil 402-1 is removed from the winding tool and placed in coil form 404-1. Often, the packing density of the windings in coil 402-1 degrades while it is physically moved from the winding tool to coil form 404-1. A reduction in the packing density of its windings reduces the propulsion efficiency of a propulsion coil. After coil 402-1 is inserted into coil form 404-1, lid 408-1 is then fixed onto coil form 404-1. In order to facilitate coil insertion into the coil form, the inner diameter of coil 402-1 is made slightly larger than the outer diameter of the hub portion of coil form 404-1. As a result, clearance gap g1 is present between coil 402-1 and the hub wall of coil form 404-1. After coil lid 408-1 is secured to coil form 404-1, the assembly is completed by injecting encapsulant 406 into the coil form to pot coil 402-1. These steps are representative of the process used to form each of stackable coils 204.

Once they are fabricated, stackable coils 204 are placed on top of one another around tube 202. In order to facilitate the placement of the stackable coils around tube 202, the inner diameter of coil forms 404 are made slightly larger than the outer diameter of tube 202. As a result, coil form clearance gap g2 is present between stackable coil 402-1 and tube wall 302.

The use of the stackable coil approach, therefore, results in a minimum separation between stackable coil 402-1 and armature coil 410 that is the total of coil clearance gap g1, hub wall thickness t1, coil form clearance gap g2, tube wall thickness t4, gap g3, and armature coil gap g4 (i.e., the distance between armature coil 410 and the edge of armature 304).

Figure 5:
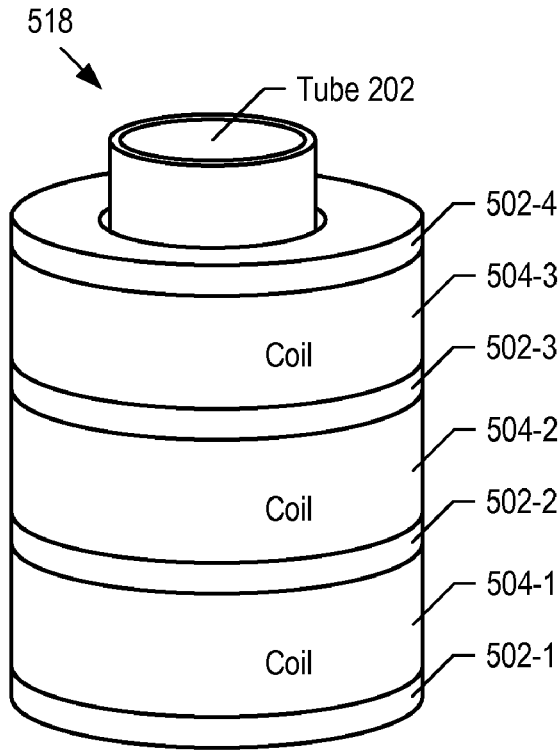
FIG. 5 depicts a perspective view of a launch tube in accordance with an illustrative embodiment of the present invention.

FIG. 5 depicts a perspective view of a launch tube in accordance with an illustrative embodiment of the present invention. Unitary barrel launch tube 518 comprises tube 202, flanges 502-1 through 502-4, and coils 504-1 through 504-3. For clarity, the outer structure of launch tube 500 (e.g., encapsulation and outer jacket), as well as the interconnection between unitary barrel launch tube 518 and power system 106 are not shown. Although the illustrative embodiment comprises four flanges and three coils, it will be clear to those skilled in the art, after reading this specification, how to make and use alternative embodiments of the present invention that comprise any number of flanges and/or any number of coils.

Although in the illustrative embodiment tube 202 has a circular cross-section, it will be clear to those skilled in the art, after reading this specification, how to make and use alternative embodiments wherein tube 202 has a non-circular cross-section such as square, rectangular, or elliptical.

Each of flanges 502-1 through 502-4 (collectively "flanges 502") is an annulus of fiber-reinforced epoxy resin that has an inner diameter slightly larger than the outer diameter of tube 202. The inner diameter of flanges 502, therefore, is suitable for accommodating the insertion of tube 202 into flanges 502. During launcher assembly, flanges 502 are slid onto tube 202 and fixed in their desired positions on tube 202. Flanges 502 are arranged on tube 202 to form spaces between them that are suitable for defining each of coils 504-1 through 504-3. Each of flanges 502 has a thickness suitable for providing adequate physical separation between two coils as shown. Although in the illustrative embodiment each of flanges 502 has substantially the same thickness, it will be clear to those skilled in the art, after reading this specification, how to make and use alternative embodiments in which flanges 502 are not all of the same thickness.

Each of coils 504-1 through 504-3 (collectively "coils 504") comprises a length of electrical conductor that is suitable for carrying sufficient electric current to generate a desired propulsive force on armature 304. Coils 504 are the propulsion coils in unitary barrel launch tube 518. Coils 504 are discussed in more detail below in with respect to FIG. 7.

A disadvantage associated with some prior-art electromagnetic missile launchers that are assembled using the stackable coil approach is an inability to customize the characteristics of the propulsion coils, such as coil width, coil spacing, coil cross-section, and/or coil wire gauge, for a specific application. Although in the illustrative embodiment flanges 502 are arranged on tube 202 with substantially uniform spacing between them, it will be clear to those skilled in the art, after reading this specification, how to make and use alternative embodiments of the present invention wherein the spacing between flanges 502 is not uniform. In addition, it will be clear to those skilled in the art, after reading this specification, how to make and use alternative embodiments wherein the thickness and/or diameter of each of flanges 502 is not uniform.

In contrast to prior-art electromagnetic missile launchers, therefore, the present invention provides a means to customize:

i. coil cross-section; or
ii. coil diameter; or
iii. coil spacing; or
iv. coil wire gauge; or
v. the coil to armature gap; or
vi. any combination of i, ii, iii, iv, and v.

A customized design regarding one or more of the above parameters i through v facilitates an improvement in some of the design and/or performance parameters of unitary barrel launch tube 518, such as the transient acceleration profile of armature 304 during launch, length of the propulsion system, weight of the propulsion system, reliability, efficiency, and performance.

Figure 6:
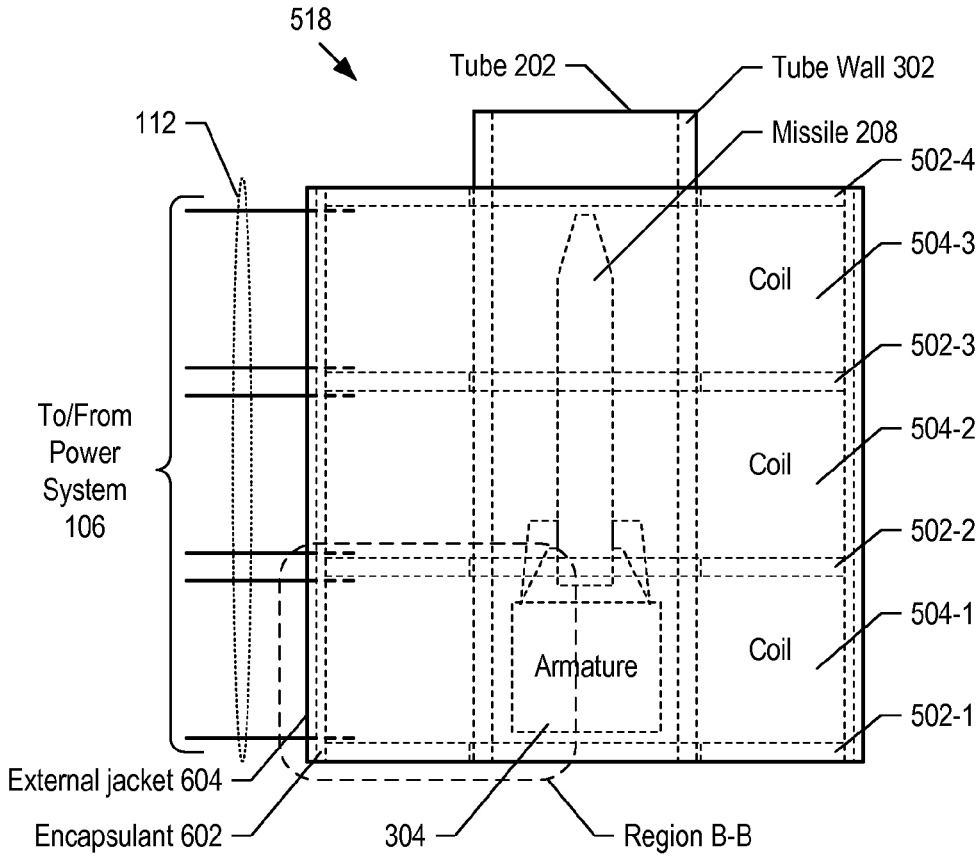
FIG. 6 depicts a side view of unitary barrel launch tube 518 in accordance with the illustrative embodiment of the present invention.

FIG. 6 depicts a side view of unitary barrel launch tube 518 in accordance with the illustrative embodiment of the present invention. Unitary barrel launch tube 518 comprises tube 202, armature 304, missile 208, flanges 502, coils 504, encapsulant 602, and outer jacket 604.

Encapsulant 602 is a flowable epoxy suitable for potting electrical windings. It will be clear to those skilled in the art how to make and use encapsulant 602.

Outer jacket 604 is a fiber wound coating that is added to unitary barrel launch tube 500 after coils 504 have been potted in encapsulant 602. The addition of encapsulant 602 and outer jacket 604 to launcher 108 reduces the need for clamp 206, described above and with respect to FIG. 2, since encapsulant 602 and outer jacket 604 serve to bond tube 202, flanges 502, and coils 504 together as a single physical unit. As a result, coils 504 are less likely to separate due to the forces to which they are subjected during a missile launch.

In similar fashion to the prior-art stackable coil approach described above and with respect to FIGS. 2-4, the propulsive force provided to armature 304 is generated by the flow of electric current in coils 502-1 through 502-3. The flow of electric current through coils 502 is controlled and sequenced by power system 106, which is connected to coils 504 through propulsion current bus 112.

Although the illustrative embodiment comprises a launcher for throwing a missile, it will be clear to those skilled in the art, after reading this specification, how to make and use alternative embodiments of the present invention that throw munitions that do not comprise a chemical-propellant engine, such as mortars or other projectiles.

Figure 7:
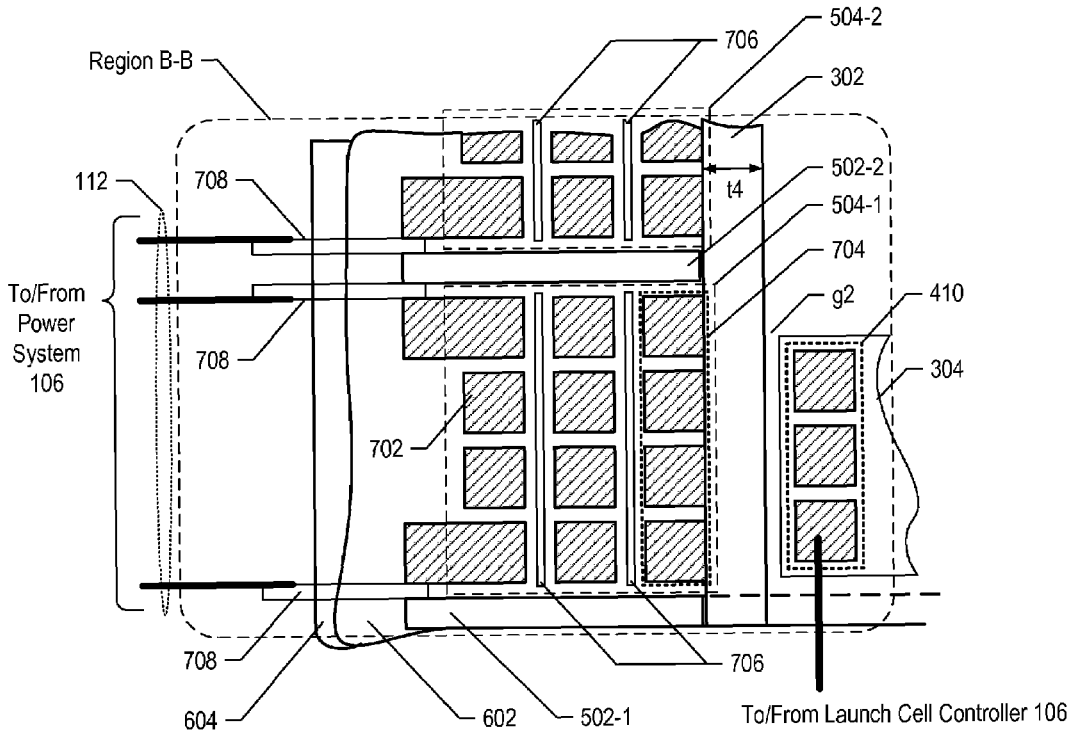
FIG. 7 depicts a cross-sectional view of a region of unitary barrel launch tube 518 in accordance with the illustrative embodiment of the present invention.

FIG. 7 depicts a cross-sectional view of a region of unitary barrel launch tube 518 in accordance with the illustrative embodiment of the present invention.

Region B-B depicts an enlarged view of a portion of propulsion coil 504-1 and some of its surrounding region. Coil 504-1 is representative of each of coils 504. Coil 504-1 comprises a length of coil wire 702. Coil wire 702 is an electrical conductor that is coated with a layer of electrical insulation. Coil wire 702 is suitable for carrying sufficient electric current to generate a desired propulsive force on armature 304. Coil 504-1 is formed of a plurality of radial layers 704, at least one of which is physically-coupled to the outer surface of tube 202. For the purposes of this specification, including the appended claims, the term "physically-coupled" means direct, physical contact between two objects (e.g., two surfaces that abut one another, etc.).

Layer 706 is a layer of permeable fabric. Layer 706 separates each radial layer 704 of coil 504-1 from its neighboring layers without significantly perturbing the magnetic field developed by coil 504-1 when coil 504-1 is energized by electric current. During electromagnetic missile launch, the propulsion coils and/or coil windings may exhibit mechanical movement due to such factors as thermal expansion or electromagnetic force. Over time, this mechanical motion may erode the insulation coating on coil wire 702. Layer 706 provides a protective barrier between radial layers 704 to protect the coil wire insulation and improve launcher reliability.

Just as in prior-art electromagnetic missile launchers, the propulsive force on armature 304 generated by each of the propulsion coils (i.e., coils 504) is a function of: the number of turns the propulsion coil contains; the electric current it carries; and the separation between the propulsion coil and the armature within tube 202. In the prior-art stackable coil approach, the efficiency of a launcher is reduced by the structural aspects inherent to the use of separate stackable coils. Specifically, as discussed above and with respect to FIG. 4, prior-art launcher performance is degraded by the need for assembly clearances such as those between coils 402 and coil forms 404 (i.e., coil clearance gap, g1), and those between coil forms 404 and the outer surface of tube 202 (i.e., coil form clearance gap, g2).

The present invention provides an electromagnetic missile launcher capable of more efficient propulsion than some prior-art electromagnetic missile launchers. In contrast to the prior art, in the present invention, the propulsion coils are wound directly onto the outer surface of tube 202. In the illustrative embodiment, the minimum separation between the propulsion coils and the armature coil is therefore reduced from that of the prior-art launcher depicted in FIG. 4 by at least the sum of coil clearance gap g1, hub wall thickness t1, and coil form clearance gap g2. As a result, the separation between the propulsion coils (i.e., coils 504) and armature 304 includes only: 1) the thickness, t4, of tube wall 302; and 2) the clearance, g4, between armature 304 and the inner wall of tube 202.

Although the illustrative embodiment comprises an armature that has an armature coil, it will be clear to those skilled in the art, after reading this specification, how to make and use alternative embodiments of the present invention that comprise an armature that does not have an armature coil.

Figure 8:
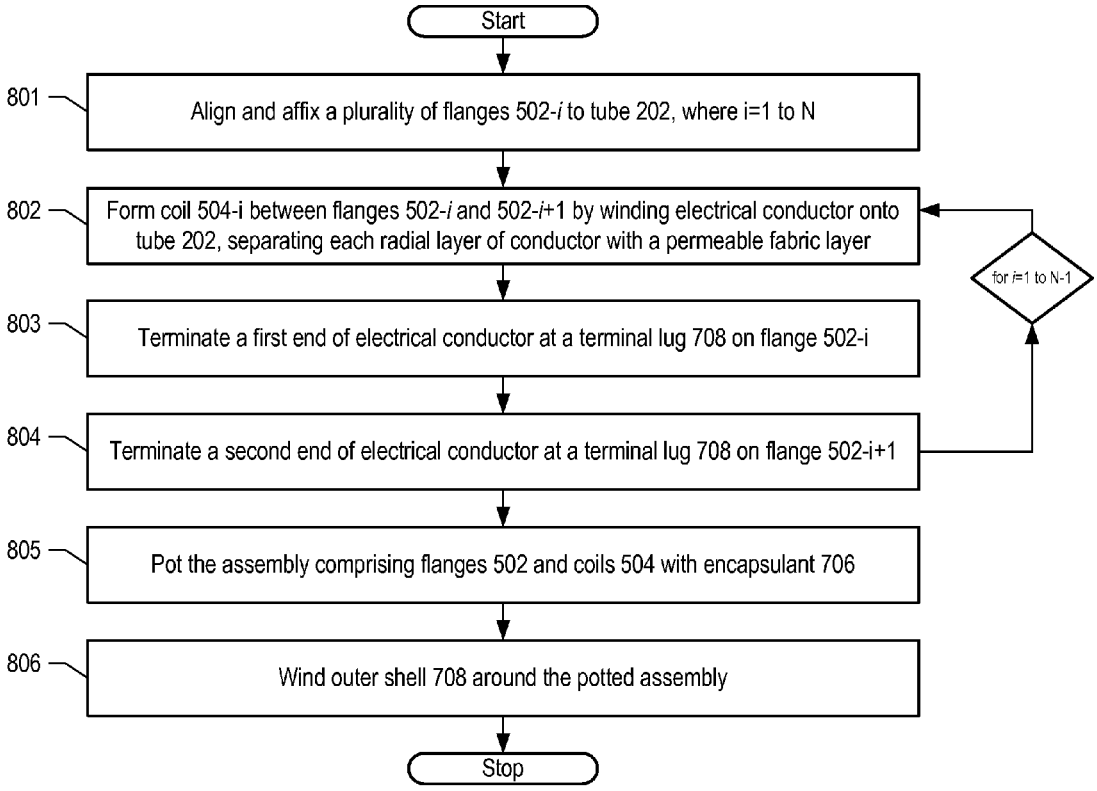
FIG. 8 depicts the salient operations for assembling a unitary barrel launch tube in accordance with the illustrative embodiment of the present invention

FIG. 8 depicts the salient operations for assembling a unitary barrel launch tube in accordance with the illustrative embodiment of the present invention.

At operation 801, flanges 502-1 through 502-4 are stacked around tube 202. Each of flanges 502 is affixed into position along tube 202 so that the spaces between the flanges are suitable for the subsequent formation of coils 504. In some alternative embodiments, reinforcing bars hold flanges 502 in place temporarily while they are being attached to tube 202.

At operations 802 through 804, each of coils 504-1 through 504-3 are formed in the spaces between flanges 502.

For example, at operation 802, coil 504-1 is formed by winding a first radial layer 704 of coil wire 702 onto the outer surface of tube 202. Prior to winding a second radial layer 704 of coil wire 702 onto the first radial layer of coil wire, a layer of permeable fabric 706 is affixed around the outside of the first radial layer. After permeable fabric 706 is added, second radial layer 704 of coil wire 702 is added to coil 504-1. Alternating layers of permeable fabric 706 and radial layers 704 of coil wire 702 are added until the desired diameter of coil 504-1 is achieved. Although in the illustrative embodiment, coil 504-1 comprises three radial layers 704 and two layers of permeable fabric 706, it will be clear to those skilled in the art, after reading this specification, how to make and use alternative embodiments of the present invention that comprise a number of radial layers 704 other than three and/or a number of layers of permeable fabric 706 other than two.

At operation 803, a first end of the coil wire that composes coil 504-1 is attached to terminal lug 708 that is attached to flange 502-1.

At operation 804, a second end of the coil wire that composes coil 504-1 is attached to terminal lug 708 that is attached to flange 502-2.

Operations 802, 803, and 804 are repeated for each of coils 504-1 through 504-3.

At operation 805, the assembly comprising flanges 502-1 through 502-4 and interposing coils 504-1 through 504-3 is potted in encapsulant 706 in well-known fashion.

At operation 806, outer shell is formed around the outside of the assembly potted in operation 805.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. An apparatus for launching a munition, wherein the apparatus comprises:

a tube having an outer surface, wherein the tube encircles an armature;

a first coil for conducting electric current, wherein the first coil is substantially immovable with respect to the tube, and wherein a portion of the first coil is physically-coupled to the outer surface of the tube;

a second coil for conducting electric current, wherein the second coil is substantially immovable with respect to the tube, and wherein a portion of the second coil is physically-coupled to the outer surface of the tube;

the armature; and a restraint having a first state and a second state, wherein the restraint couples the munition and the armature when the restraint is in the first state, and wherein the restraint decouples the munition and the armature when the restraint is in the second state;

wherein the flow of electric current in at least one of the first coil and the second coil induces the armature to move with respect to the tube and throw the munition.

2. The apparatus of claim 1 further comprising a first flange, a second flange, and a third flange, wherein the first flange, the second flange, and the third flange are affixed to the tube, and wherein the first flange and the second flange define a first coil region that locates the first coil, and further wherein the second flange and the third flange define a second coil region that locates the second coil.

3. The apparatus of claim 2 wherein the first coil region has a first coil-region-width, and wherein the second coil region has a second coil-region-width, and wherein the first coil-region-width and the second coil-region-width are equal.

4. The apparatus of claim 2 wherein the first coil region has a first coil-region-width, and wherein the second coil region has a second coil-region-width, and wherein the first coil-region-width and the second coil-region-width are unequal.

5. The apparatus of claim 2 wherein the first flange has a first flange-thickness, the second flange has a second flange-thickness, and the third flange has a third flange-thickness, and wherein the first flange thickness, the second flange thickness, and the third flange thickness are equal.

6. The apparatus of claim 2 wherein the first flange has a first flange-thickness, the second flange has a second flange-thickness, and wherein the first flange thickness and the second flange thickness are unequal.

7. The apparatus of claim 1 further comprising a controller for controlling the flow of electric current in the first coil and the second coil.

8. The apparatus of claim 1 wherein the armature comprises a third coil for conducting electric current, and wherein the third coil is immovable with respect to the armature.

9. The apparatus of claim 8 further comprising a controller for controlling the flow of electric current in the first coil, the second coil, and the third coil.

10. The apparatus of claim 1 further comprising the munition, wherein the munition comprises a chemical propellant engine.

11. The apparatus of claim 1 further comprising a permeable fabric layer, wherein the first coil comprises a plurality of radial layers of coil winding, and wherein the permeable fabric layer interposes two radial layers of coil windings.

12. An apparatus for launching a munition, wherein the apparatus comprises:

a tube having an outer surface, wherein the tube encircles an armature;

a first coil of electrically conductive material, wherein the first coil is substantially immovable with respect to the tube, and wherein a portion of the first coil is physically-coupled to the outer surface of the tube;

a second coil of electrically conductive material, wherein the second coil is substantially immovable with respect to the tube, and wherein a portion of the second coil is physically-coupled to the outer surface of the tube; end a first flange, a second flange, and a third flange, wherein the first flange, the second flange, and the third flange are affixed to the tube, and wherein the first flange and the second flange define a first coil region that locates the first coil, and further wherein the second flange and the third flange define a second coil region that locates the second coil; and the armature, wherein the armature locates the munition;

wherein the flow of electric current in the first coil induces a first acceleration of the armature in a first direction, and wherein the flow of electric current in the second coil induces a second acceleration of the armature in the first direction.

13. The apparatus of claim 12 wherein the armature comprises a third coil of electrically conductive material, and wherein a portion of the third coil is physically-coupled to the outer surface of the tube, and further wherein the flow of electric current in the third coil induces a third acceleration of the armature in the first direction.

14. The apparatus of claim 13 further comprising a controller, wherein the controller controls the flow of electric current in the first coil, the second coil, and the third coil to induce the armature to throw the munition.

15. The apparatus of claim 12 further comprising a permeable fabric layer, wherein the first coil comprises a plurality of radial layers of coil winding, and wherein the permeable fabric layer interposes two radial layers of coil windings.

16. The apparatus of claim 12 further comprising the munition.

17. The apparatus of claim 12 wherein the first coil region has a first coil-region-width, and wherein the second coil region has a second coil-region-width, and wherein the first coil-region-width and the second coil-region-width are equal.

18. The apparatus of claim 12 wherein the first coil region has a first coil-region-width, and wherein the second coil region has a second coil-region-width, and wherein the first coil-region-width and the second coil-region-width are unequal.

* * * * *